US008585383B2

(12) United States Patent
Hwang et al.

(10) Patent No.: US 8,585,383 B2
(45) Date of Patent: Nov. 19, 2013

(54) SCROLL FLUID MACHINE

(75) Inventors: BooSeok Hwang, Tokyo (JP); KwangSeon Hwang, Jeonbuk (KR)

(73) Assignees: RichStone Limited, Tokyo (JP); RichStone Limited, Jeonju (KR)

( * ) Notice: Subject to any disclaimer, the term of this patent is extended or adjusted under 35 U.S.C. 154(b) by 336 days.

(21) Appl. No.: 12/925,998

(22) Filed: Nov. 5, 2010

(65) Prior Publication Data

US 2011/0123324 A1 May 26, 2011

(30) Foreign Application Priority Data

Nov. 25, 2009 (JP) ..... 2009-268165

(51) Int. Cl.
*F01C 1/02* (2006.01)
*F01C 21/04* (2006.01)
*F01M 1/00* (2006.01)

(52) U.S. Cl.
USPC ..... 418/55.6; 418/55.1; 418/94; 184/6.16

(58) Field of Classification Search
USPC ..... 418/55.1, 204, 55.3, 55.6, 91, 94, 88; 415/204; 184/6.13, 6.16; 384/213; 464/7
See application file for complete search history.

(56) References Cited

U.S. PATENT DOCUMENTS

| | | | | | |
|---|---|---|---|---|---|
| 2,825,241 | A | * | 3/1958 | Ferris | 74/579 R |
| 3,560,119 | A | * | 2/1971 | Hufnagel et al. | 418/55.3 |
| 3,592,233 | A | * | 7/1971 | Woodling | 137/625.21 |
| 3,989,422 | A | * | 11/1976 | Guttinger | 418/55.1 |
| 4,762,478 | A | * | 8/1988 | Sakurai et al. | 418/55.1 |
| 5,011,386 | A | * | 4/1991 | Guttinger | 418/59 |

FOREIGN PATENT DOCUMENTS

| | | | | |
|---|---|---|---|---|
| JP | 1995-026618 | B | | 3/1995 |
| JP | 1997-112447 | A | | 5/1997 |
| JP | 09112447 | A | * | 5/1997 |
| JP | 2004-332695 | A | | 11/2004 |
| JP | 2004332695 | A | * | 11/2004 |

* cited by examiner

*Primary Examiner* — Thomas Denion
*Assistant Examiner* — Laert Dounis

(57) ABSTRACT

In a scroll fluid machine where an orbiting scroll fixed to a pivot shaft eccentrically revolves, a fixed portion is provided on a bottom of a casing, and a swing column is provided between the fixed portion and the orbiting scroll or between the fixed portion and the pivot shaft. The fixed portion withstands the thrust load of the orbiting scroll, which has been transferred by the swing column.

3 Claims, 6 Drawing Sheets

SCROLL FLUID MACHINE

PRIORITY

This application claims priority to Japanese Patent Application JP2009-268165, filed Nov. 25, 2009, which is incorporated by reference herein, in its entirety.

BACKGROUND OF THE INVENTION

1. Field of the Invention

The invention relates to a scroll fluid machine such as a compressor, a blower, a vacuum pump, a liquid pump, and an expander.

2. Description of the Related Art

In an existing scroll fluid machine for driving an orbiting scroll fixed to a pivot shaft as disclosed in Japanese Examined Patent Application Publication No. JP,1995-026618,B (29 Mar. 1995), the thrust load of the orbiting scroll is transferred to the pivot shaft, which is then borne by the bearing supporting the pivot shaft, and the bearing supporting the rotary shaft.

Japanese Unexamined Patent Application Publication Nos. JP,1997-112447,A (2 May 1997) and JP,2004-332695,A (25 Nov. 2004) disclose an existing scroll fluid machine of the crank drive type provided with three or more swing columns between the casing and the orbiting scroll.

SUMMARY OF THE INVENTION

The scroll fluid machine disclosed in Japanese Examined Patent Application Publication No. JP,1995-026618,B requires a large number of bearings that consequently need an increase in bearing diameter for prolonging bearing life, resulting in large mechanical loss which occurs in the bearings, while making the structure complicated and costly.

As disclosed in Japanese Unexamined Patent Application Publication Nos. JP,1997-112447,A and JP,2004-332695,A, the scroll fluid machine includes three or more swing columns, resulting in a complicated structure.

The present invention provides a simply structured scroll fluid machine with less mechanical loss, which sufficiently bears a large thrust load of the orbiting scroll by preventing the thrust load from being borne by the bearing for supporting the pivot shaft (for example, angular ball bearing) and the bearing for supporting the rotary shaft (for example, angular ball bearing).

The present invention is applied to a scroll fluid machine which includes a casing, a rotary shaft having a hollow portion, a pivot shaft, an orbiting scroll, and a fixed scroll. The hollow rotary shaft is provided inside the casing and supported at a bearing for rotation. The pivot shaft is provided in the hollow portion of the rotary shaft and supported at a bearing eccentrically located from an axial center of the rotary shaft for orbital revolution. The orbiting scroll is engaged with a leading end of the pivot shaft for revolution while being prevented from self-rotating by a self-rotation prevention mechanism. The fixed scroll is provided opposite the orbiting scroll, which defines a work chamber with the orbiting scroll. The scroll fluid machine is further provided with a fixed portion on a bottom of the casing, and a swing column between the fixed portion and the orbiting scroll, or between the fixed portion and the pivot shaft to withstand the thrust load. The swing column is allowed to transfer the thrust load of the orbiting scroll to the fixed portion.

In a preferred embodiment, the fixed portion includes a bearing fitted to one end of the swing column. The orbiting scroll or the pivot shaft includes a bearing fitted to the other end of the swing column. The swing column includes convex or concave spherical surface at one end and the other end. The swing column includes the oil passage which penetrates through the axis core to supply the oil to the portion where the bearing of the fixed portion is fitted to the one end of the swing column, and to further supply the oil to the portion where the bearing of the orbiting scroll or the bearing of the pivot shaft is fitted to the other end of the swing column. The scroll fluid machine includes means for supplying the oil to the swing column. One end of the swing column fitted to the bearing of the fixed portion serves as a support point. The other end of the swing column fitted to the bearing of the orbiting scroll or the bearing of the pivot shaft revolves while following the movement of the orbiting scroll or the pivot shaft.

Preferably, the swing column has a swingable motion while being prevented from self-rotating and prevents a self-rotation of the orbiting scroll.

In a preferred implementation, one end and the other end of the swing column are each provided with a columnar pin. The axis of each of the pins passes through an axis of the swing column. Each of the pins orthogonally crosses the swing column. A guide groove is formed in the fixed portion and the orbiting scroll, or the fixed portion and the pivot shaft. Each of the guide grooves accommodates one of the pins. The guide groove has a width equal to or slightly wider than a diameter of the pin.

In the scroll fluid machine according to the present invention, the thrust load of the orbiting scroll is transferred to the fixed portion through the swing column with a simple structure and less mechanical loss for bearing such a thrust load rather than borne by the bearings for supporting the pivot shaft and the rotary shaft. The swing column includes the oil passage which penetrates through the axis core to supply the oil to the portion where the one end of the swing column is fitted and to further supply the oil through the oil passage to the portion where the other end of the swing column is fitted. The swing column can withstand a higher thrust load while markedly reducing the thrust load exerted on the bearings, prolonging the life of bearings and reducing the size of the scroll fluid machine.

In the case the swing column includes the oil passage which penetrates through the axis core to supply the oil to the portion where the bearing of the fixed portion is fitted to the one end of the swing column, and to further supply the oil to the portion where the bearing of the orbiting scroll or the bearing of the pivot shaft is fitted to the other end of the swing column, and where one end of the swing column, which is fitted to the bearing of the fixed portion serves as a support point, and the other end of the swing column, which is fitted to the bearing of the orbiting scroll or the pivot shaft revolves while following the movement of the orbiting scroll or the pivot shaft, the bearings for supporting the pivot shaft and the rotary shaft do not have to withstand the thrust load of the orbiting scroll. This makes it possible to produce the compact scroll fluid machine with a simple bearing structure and less mechanical loss.

If the swing column prevents self-rotation of the orbiting scroll, a component dedicated for preventing self-rotation is not required. This makes it possible to simplify the structure of the scroll fluid machine, and to reduce vibration noise compared with the case where the reciprocating member is employed.

In the case where one end and the other end of the swing column are each provided with a columnar pin, and the guide groove is formed in the fixed portion and the orbiting scroll, or in the fixed portion and the pivot shaft, self-rotation of the swing column and the orbiting scroll may be prevented with the simple structure.

DESCRIPTION OF THE PREFERRED EMBODIMENTS

First Embodiment

Figure 1:
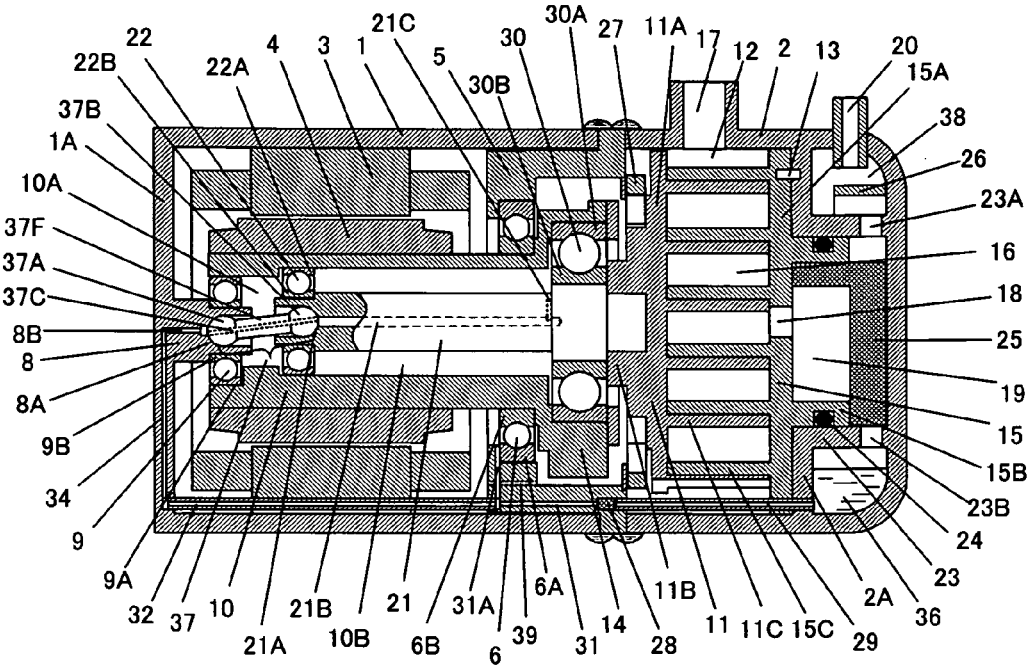
FIG. 1 is a sectional view illustrating a compressor according to a first embodiment.

FIG. 1 illustrates a compressor according to a first embodiment. A motor is formed of a stator 3 and a rotor 4. The stator 3 and a frame 5 are fixed to a casing 1. An outer race 6A of a main bearing 6 is attached to the frame 5. A fixed portion 8 is provided opposite a scroll side of the casing 1, that is, on a bottom 1A. An inner race 9B of a secondary bearing 9 is attached to the fixed portion 8. The fixed portion 8 extends to reach a hollow portion 10A of a rotary shaft 10. The rotary shaft 10 includes hollow portions 10A and 10B each having a different center axis. The center axis of the hollow portion 10A coincides with that of the rotary shaft 10. The center axis of the hollow portion 10B is eccentrically located from the center axis of the rotary shaft 10 by a distance substantially corresponding to the pivoting radius. The hollow portion 10A is positioned at the lower end portion of the rotary shaft 10. The hollow portion 10B is positioned from a leading end to an intermediate portion of the rotary shaft 10. An outer race 30A of a pivot main bearing 30 is attached to a front portion of the hollow portion 10B, and an outer race 22A of a pivot secondary bearing 22 is attached to a rear portion of the hollow portion 10B.

The main bearing 6 and the secondary bearing 9 are configured to withstand only the radial load (for example, deep groove ball bearing). The front portion of the rotary shaft 10 is supported at the inner race 6B of the main bearing 6, and the rear portion is supported at the outer race 9A of the secondary bearing 9. The aforementioned structure allows the rotary shaft 10 to be rotatably supported at the main bearing 6 and the secondary bearing 9.

The pivot main bearing 30 and the pivot secondary bearing 22 are configured to withstand only the radial load (for example, deep groove ball bearing). The front portion of the pivot shaft 21 is supported at an inner race 30B of the pivot main bearing 30, and the rear portion is supported at an inner race 22B of the pivoting secondary bearing 22. The aforementioned structure allows the pivot shaft 21 to be rotatably supported at the pivot main bearing 30 and the pivot secondary bearing 22.

A cover 2 attached to the casing 1 with a bolt includes an inlet 17 and an outlet 20 in the upper portion of the outer circumference, and further includes an intake chamber 12 at an inner circumference. A partition 2A and a guide cylinder 23 are provided in the cover 2. A fixed scroll 15 provided inside the cover 2 is mainly formed of paneling 15A, a cylinder 15B and a wrap 15C. The cylinder 15B is movably fitted to the guide cylinder 23 in an axial direction. A columnar pin 13 is buried in the outer circumference of the partition 2A. A leading end of the pin 13 is fitted to a hole formed in the paneling 15A. The pin 13 serves to prevent rotation of the fixed scroll 15.

An outlet port 18 is formed in the paneling 15A. A sealing member 24 is fitted to the cylinder 15B for sealing a clearance between the cylinder 15B and the guide cylinder 23. The thus formed structure defines a first discharge chamber 19 inside the guide cylinder 23. A mesh 25 is provided inside the first discharge chamber 19. A second discharge chamber 38 is defined by an outer circumference of the guide cylinder 23 and the cover 2. A collision plate 26 for oil separation is provided above the second discharge chamber 38. An oil sump 36 is provided below the second discharge chamber 38. A gas passage 23A and an oil drop hole 23B are provided above and below the guide cylinder 23, respectively.

An orbiting scroll 11 provided opposite the fixed scroll 15 is mainly formed of paneling 11A, a boss 11B and a wrap 11C. The boss 11B is engaged with a leading end of a pivot shaft 21. A substantially sealed work chamber (compression chamber) 16 is defined by the paneling 11A and the wrap 11C of the orbiting scroll 11, the paneling 15A and the wrap 15C of the fixed scroll 15. An Oldham's ring 27 is provided on an outer circumference of a back surface of the paneling 11A of the orbiting scroll 11. The Oldham's ring 27 serves as a self-rotation prevention mechanism.

A bearing (concave spherical bearing) 8A is attached to a leading end of the fixed portion 8, and a bearing (concave spherical bearing) 21A is attached to a rear end of the pivot shaft 21. A swing column 37 is provided between the bearings 8A and 21A. The swing column 37 is formed by interposing a cylinder 37F between a sphere 37A at one end and a sphere 37B at the other end. Each core of the spheres 37A and 37B coincides with an axis of the cylinder 37F. The spherical radius of the bearing 8A is substantially equal to that of the sphere 37A. So the sphere 37A is swingably fitted to the bearing 8A without being disengaged therefrom. The spherical radius of the bearing 21A is also substantially equal to that of the sphere 37B, and accordingly, the sphere 37B is swingably fitted to the bearing 21A without being disengaged therefrom. The swing column 37 includes an oil passage 37C which penetrates through the axis core. A counterweight 14 is provided on the rotary shaft 10 for balancing centrifugal forces of the orbiting scroll 11 and the pivot shaft 21.

A first oil passage 31 and an oil return hole 39 are formed below the frame 5. A first oil supply pipe 29 passes from the oil sump 36 through the partition 2A and the paneling 15A of the fixed scroll 15 so as to be connected to the first oil passage 31 via a filter 28. A branch oil passage 31A is branched from the first oil passage 31 to the portion around the main bearing 6. One end of a second oil supply pipe 32 is connected to the first oil passage 31. A second oil passage 34 is formed in the bottom 1A. The other end of the second oil supply pipe 32 is connected to the second oil passage 34. The second oil passage 34 is communicated with an oil passage 8B of the fixed portion 8. A terminal end of the oil passage 8B is opened to the bearing 8A. An oil passage 21B is formed at the center of the pivot shaft 21. A lateral hole 21C is formed from the oil passage 21B to the portion around the pivot main bearing 30. The oil passage 37C of the swing column 37 connects the oil passages 8B and 21B.

An operation of the first embodiment will be described. Upon application of electricity to the motor, the stator 3 applies the rotational force to the rotor 4 to rotate the rotary shaft 10. The rotation allows the pivot shaft 21 and the orbiting scroll 11 integrated with the pivot shaft 21 to revolve. The orbiting scroll 11 revolves while its self-rotation being prevented by the Oldham's ring 27.

Gas (work fluid) flows into the intake chamber 12 from the inlet 17, and moves toward the center while being compressed in the compression chamber 16. It then flows into the first discharge chamber 19 from the outlet port 18. Thereafter, the gas flows upward from the gas passage 23A to impinge upon the collision plate 26. The movement direction of the gas is changed so as to be discharged outward from the outlet 20.

The oil (lubricant oil) is fed from the oil sump 36 into the first oil supply pipe 29 under the pressure difference between high pressure of the second discharge chamber 38 and the low pressure inside the casing 1, and flows into the first oil passage 31 so as to be supplied from the branch oil passage 31A to the portion around the main bearing 6. The oil passes through the second oil supply pipe 32, the second oil passage 34 and the fixed oil passage 8B to be supplied to a portion (sliding portion) where the bearing 8A is fitted to the sphere 37A. The oil passes through the oil passage 37C to be supplied to the portion (sliding portion) where the bearing 21A is fitted to the sphere 37B. The oil which leaks from the bearings 8A and 21A is supplied to the secondary bearing 9 and the pivot secondary bearing 22. The oil flows into the oil passage 21B of the pivot shaft 21 so as to be supplied from the lateral hole 21C to the pivot main bearing 30. As described above, the respective bearings and sliding portions are lubricated with oil.

The oil finally accumulates in the casing 1, and flows into the intake chamber 12 from the oil return hole 39. It then flows into the compression chamber 16 together with gas, and is discharged from the outlet port 18. The oil contained in the gas is separated from the gas through the mesh 25, and drops down to the oil sump 36 from the oil drop hole 23B. The oil is further separated when it impinges upon the collision plate 26 to change its movement direction, and drops down to the oil sump 36 along the guide cylinder 23.

When the gas is compressed in the compression chamber 16, the orbiting scroll 11 withstands the thrust load in a direction away from the fixed scroll 15 under the pressure of the gas so that the pivot shaft 21 is pressed down. The pivot shaft 21 transfers the thrust load from the orbiting scroll 11 to the swing column 37. The swing column 37 further transfers the thrust load from the pivot shaft 21 to the fixed portion 8. The sphere 37A (at one end of the swing column 37) fitted to the bearing (concave spherical bearing) 8A of the fixed portion 8 serves as the support point. The sphere 37B (at the other end of the swing column 37) fitted to the bearing (concave spherical bearing) 21A of the pivot shaft 21 revolves while following the movement of the pivot shaft 21. Even if a force is applied to press down the fixed portion 8 through the pivot shaft 21 and the swing column 37 from the orbiting scroll 11, the swing column 37 is kept stationary as the fixed portion 8 is fixed. As the swing column 37 is not moved, the pivot shaft 21 is kept stationary as well. The pivot shaft 21 is not moved so that the orbiting scroll 11 is kept stationary. In other words, the orbiting scroll 11 does not move away from the fixed scroll 15.

In the first embodiment, the thrust load of the pivot shaft 21 is transferred to the fixed portion 8 for withstanding such a load using the swing column 37 at the low sliding speed. Only a radial load is applied to the pivot main bearing 30, the pivot secondary bearing 22, the main bearing 6, and the secondary bearing while no thrust load is exerted. The resultant compressor has a simply structured bearing with reduced mechanical loss, resulting in improved performance. Compared with the structure in which the thrust load is exerted on the bearing, the structure of the embodiment can withstand a higher thrust load.

Figure 2:
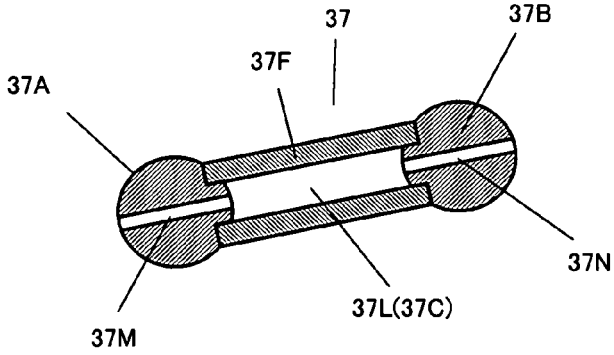
FIG. 2 represents a method for producing the swing column according to the first embodiment.

FIG. 2 represents a method for producing the swing column 37 provided with the oil passage 37C according to the first embodiment. The swing column 37 is formed by bonding the cylinder 37F between the spheres 37A and 37B through welding and using adhesive agent. Oil holes 37M and 37N are formed in the spheres 37A and 37B, respectively. A hollow portion of the cylinder 37F serves as an oil hole 37L. As the cylinder 37F which originally includes the hole is used, the machining step for forming the oil hole 37L in the cylinder is not necessary. This makes it possible to produce the swing column 37 having the oil passage 37C formed of the oil holes 37L, 37M, and 37N at a relatively lower cost.

Second Embodiment

Figure 3:
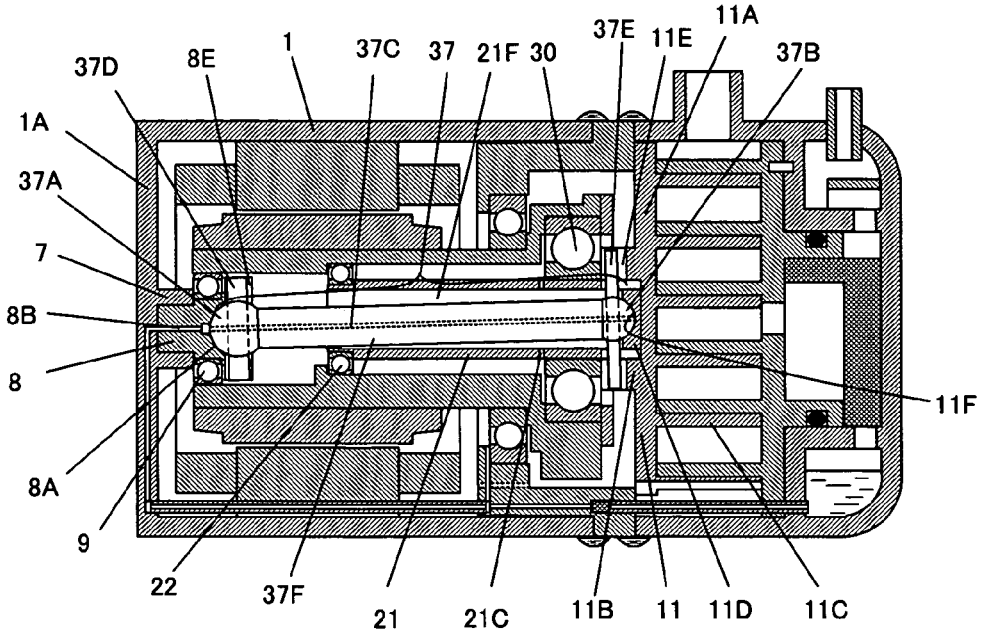
FIG. 3 is a sectional view illustrating a compressor according to a second embodiment.

FIG. 3 illustrates a compressor according to a second embodiment. The same components as those shown in FIG. 1 will be designated with the same codes described in the first embodiment, and explanations thereof, thus will be omitted. The pivot shaft 21 has a hollow portion 21F which penetrates therethrough. The swing column 37 has the sphere 37A at one end, and the sphere 37B at the other end. The swing column 37 penetrates through the hollow portion 21F. The orbiting scroll 11 is mainly formed of the paneling 11A, the boss 11B, the wrap 11C and a spherical base 11D. The spherical base 11D is provided within the boss 11B. The spherical base 11D includes a bearing (concave spherical bearing) 11F at the center portion. The sphere 37B (at the other end of the swing column 37) is swingably fitted to the bearing 11F, and includes a columnar pin 37E. The pin 37E has its axis passing through the core of the sphere 37B. The pin 37E orthogonally crosses the swing column 37. The boss 11B includes a guide groove 11E having the width substantially equal to the diameter of the pin 37E. The pin 37E is slidably fitted to the guide groove 11E so as to prevent relative rotation of the swing column 37 with respect to the orbiting scroll 11. That is, rotation of the swing column 37 with respect to the orbiting scroll 11 or the rotation of the orbiting scroll 11 with respect to the swing column 37 is prevented. In other words, the swing column 37 serves as the self-rotation prevention mechanism.

The sphere 37A (at one end of the swing column 37) includes a columnar pin 37D, an axis of which passes through the core of the sphere 37A. The pin 37D orthogonally crosses the swing column 37. The boss 7 is provided on the bottom 1A of the casing 1. The fixed portion 8 is fitted to the boss 7. The secondary bearing 9 is attached to the fixed portion 8. The fixed portion 8 includes a guide groove 8E. The width of the guide groove 8E is substantially equal to the diameter of the pin 37D. The pin 37D is slidably fitted to the guide groove 8E to prevent the swing column 37 from rotating relative to the fixed portion 8. Accordingly, the orbiting scroll 11 is prevented from rotating relative to the fixed portion 8 while being prevented from self-rotating. The swing column 37 is swingably operated while being prevented from self-rotating for the purpose of preventing self-rotation of the orbiting scroll 11.

The sphere 37A fitted to the bearing (concave spherical bearing) 8A of the fixed portion 8 serves as the support point. The sphere 37B fitted to the bearing (concave spherical bearing) 11F provided on the spherical base 11D of the orbiting scroll 11 revolves while following the movement of the orbiting scroll 11. The swing column 37 transfers the thrust load exerted from the orbiting scroll 11 through the bearing 11F and the sphere 37B on the fixed portion 8 through the sphere 37A and the bearing 8A. Then the fixed portion 8 withstands the thrust load from the orbiting scroll 11. As the fixed portion 8 is fixed, the swing column 37 does not move toward the direction where the thrust load is applied, and accordingly, the orbiting scroll 11 is kept stationary.

The swing column 37 includes the oil passage 37C which penetrates through the axis core. The oil is supplied from the oil passage 8B of the fixed portion 8 to the portion where the bearing 8A is fitted to the sphere 37A. It further passes the oil passage 37C to be supplied to the portion where the sphere 37B is fitted to the bearing 11F. The oil which is supplied from the bearing 8A to the oil passage 37C, and leaks out will be supplied to the secondary bearing 9, the pivot secondary bearing 22 and the sliding portion of the pin 37D. The oil which leaks out of the bearing 11F is supplied to the sliding portion of the pin 37E, and flows to the hollow portions 21F of the pivot shaft 21 so as to be supplied from the lateral hole 21C to the pivot main bearing 30.

According to the second embodiment, the swing column 37 withstands the thrust load of the orbiting scroll 11 and transfers it to the fixed portion 8. The fixed portion 8 withstands the thrust load transferred from the swing column 37. The resultant effects are the same as those obtained in the first embodiment. The swing column 37 further serves to prevent self-rotation of the orbiting scroll 11. By this, the compressor no longer needs the dedicated self-rotation prevention member, resulting in the simplified structure. The swing column 37 generates less vibration noise than the one generated by the reciprocating member.

Third Embodiment

Figure 4:
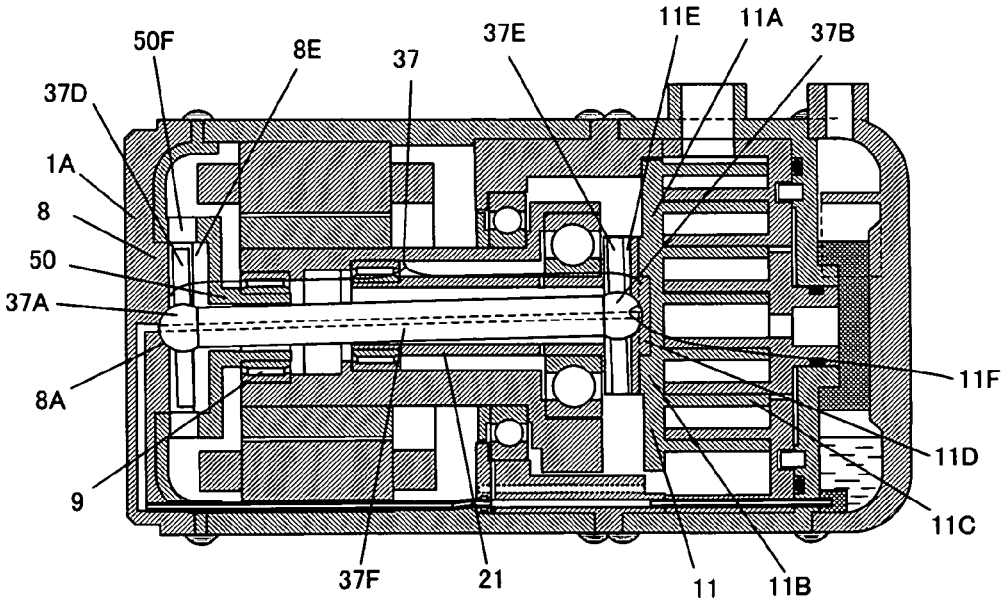
FIG. 4 is a sectional view illustrating a compressor according to a third embodiment.

FIG. 4 illustrates a compressor according to a third embodiment. Explanations of the same components and codes shown in FIGS. 1 to 3, which have been described in the first and the second embodiments will be omitted. The orbiting scroll 11 is mainly formed of the paneling 11A, the boss 11B, the wrap 11C and the spherical base 11D. The spherical base 11D is provided inside the boss 11B, and includes the guide groove 11E and the bearing (concave spherical bearing) 11F. The swing column 37 is formed by bonding the cylinder 37F between the spheres 37A at one end and the sphere 37B at the other end. The sphere 37B (at the other end of the swing column 37) includes the columnar pin 37E which protrudes outward. The axis of the pin 37E passes through the core of the sphere 37B. The pin 37E orthogonally crosses the swing column 37. The bearing 11F has the spherical radius which is substantially equal to that of the sphere 37B. The width of the guide groove 11E is substantially equal to the diameter of the pin 37E. The sphere 37B is swingably fitted to the bearing 11F. The pin 37E is slidably fitted to the guide groove 11E so as to prevent the swing column 37 from rotating relative to the orbiting scroll 11.

The fixed portion 8 provided on the bottom 1A of the casing 1 includes the bearing 8A (concave spherical bearing) and the guide groove 8E. The sphere 37A (at one end of the swing column 37) includes the columnar pin 37D which extends outward. The axis of the pin 37D passes through the core of the sphere 37A. The pin 37D orthogonally crosses the swing column 37. The spherical radius of the bearing 8A is substantially equal to that of the sphere 37A. The width of the guide groove 8E is substantially equal to the diameter of the pin 37D. The sphere 37A is swingably fitted to the bearing 8A of the fixed portion 8. A fixed shaft 50 is fitted to the fixed portion 8, and provided with the secondary bearing 9. A pin fitting hole 50F is formed in the fixed shaft 50 so that the pin 37D is laterally inserted. The pin 37D is slidably fitted to the guide groove 8E to prevent the swing column 37 from rotating relative to the fixed portion 8. Accordingly, the orbiting scroll 11 is prevented from rotating relative to the fixed portion 8, that is, self-rotating. The swing column 37 is swingably operated while being prevented from self-rotating for the purpose of preventing self-rotation of the orbiting scroll 11.

The sphere 37A fitted to the bearing (concave spherical bearing) 8A of the fixed portion 8 serves as the support point. The sphere 37B fitted to the bearing (concave spherical bearing) 11F of the orbiting scroll 11 revolves while following the movement of the orbiting scroll 11. The swing column 37 withstands the thrust load from the orbiting scroll 11 through the bearing 11F and the sphere 37B, and transfers the load to the fixed portion 8 through the sphere 37A and the bearing 8A. Then the fixed portion 8 withstands the thrust load of the orbiting scroll 11. As the fixed portion 8 is fixed, the swing column 37 does not move toward the thrust load. As the swing column 37 does not move, the orbiting scroll 11 is kept stationary.

The third embodiment provides the same effects as those obtained in the second embodiment. As the guide groove 8E is positioned radially outer than the secondary bearing 9, the length of the pin 37D may be increased. The stabilized swing column 37 makes it possible to prevent self rotation of the orbiting scroll 11.

Fourth Embodiment

Figure 5:
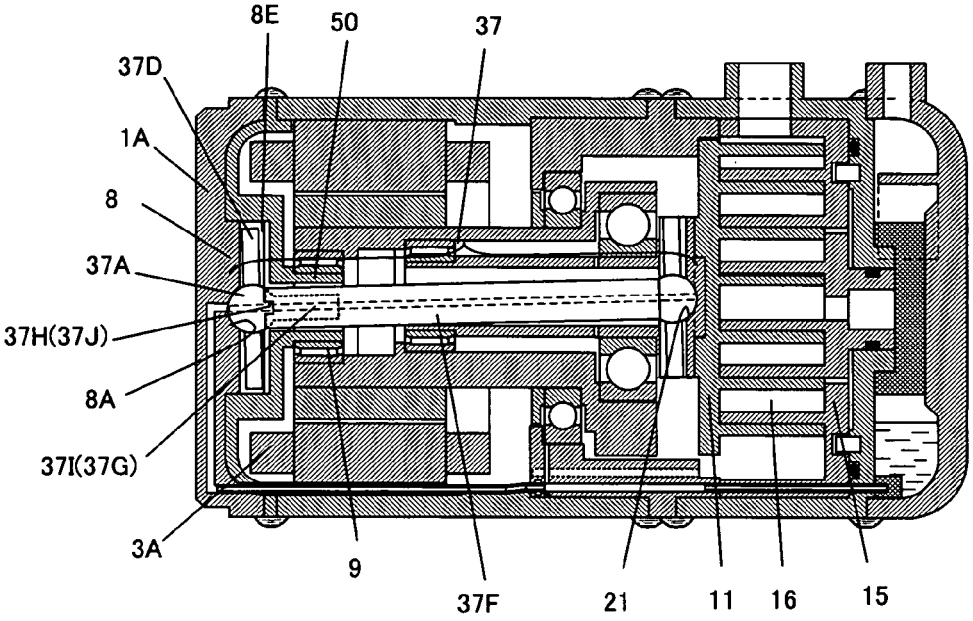
FIG. 5 is a sectional view illustrating a compressor according to a fourth embodiment.

FIG. 5 illustrates a compressor according to a fourth embodiment. Explanations of the same components and codes shown in FIGS. 1 to 4, which have been described in the first to the third embodiments will be omitted. The sphere 37A (at one end) of the swing column 37 is separated from the cylinder 37F. The sphere 37A includes a spherical shaft 37I and a spherical key 37J. The spherical shaft 37I connects the sphere 37A to the cylinder 37F. The cylinder 37F includes a cylinder hole 37G and a cylinder key groove 37H. The cylinder hole 37G is fitted to the spherical shaft 37I. The spherical key 37J is fitted to the cylinder key groove 37H. In this way, the sphere 37A is integrated with the cylinder 37F so as to prevent the sphere 37A and the cylinder 37F from rotating with respect to each other.

The fourth embodiment provides the same effects as those obtained in the third embodiment. The sphere 37A with the pin 37D may be attached from the rear portion of the fixed shaft 50 so that a stator coil 3A does not interrupt insertion of the pin 37D. It is possible to position the sphere 37A, the pin 37D, the guide groove 8E and the fixed portion 8 at the inner side of the stator coil 3A for reducing the entire length of the compressor.

Fifth Embodiment

Figure 6:
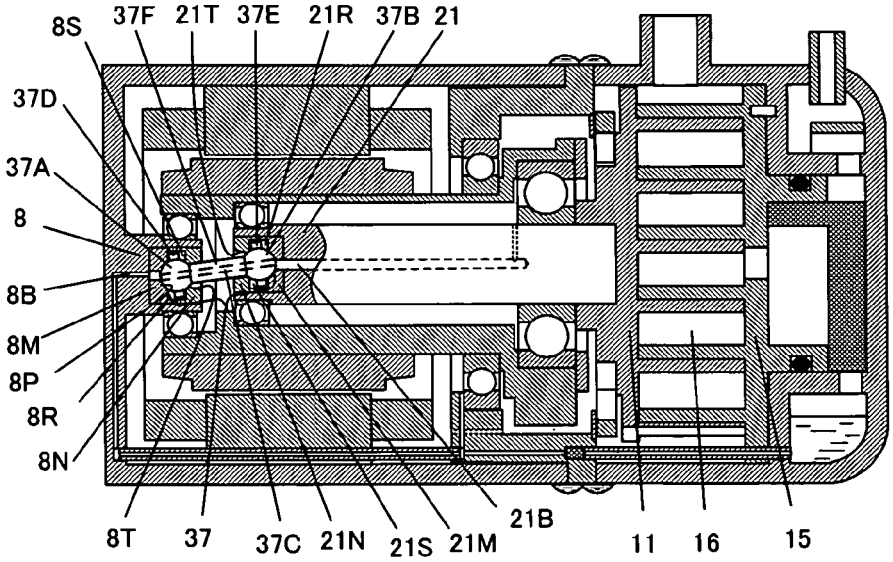
FIG. 6 is a sectional view illustrating a vacuum pump according to a fifth embodiment.
Figure 7:
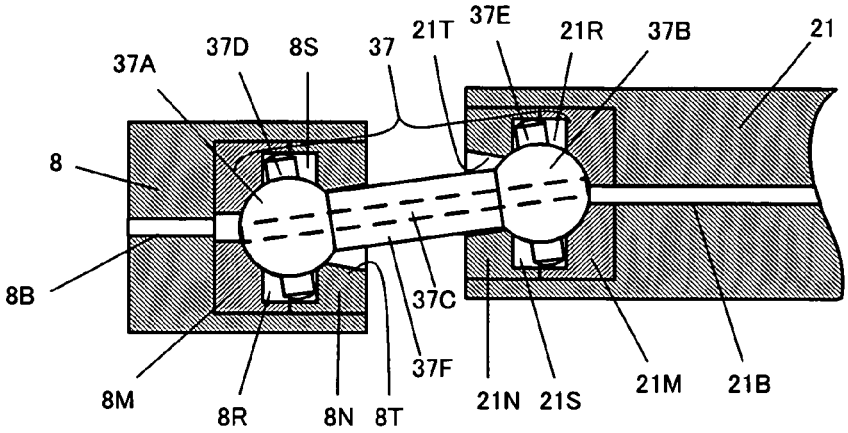
FIG. 7 is a sectional view illustrating an assembled part of the swing column according to the fifth embodiment.
Figure 8:
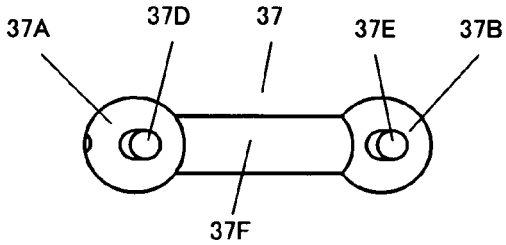
FIG. 8 is an outer appearance of the swing column according to the fifth embodiment.
Figure 9:
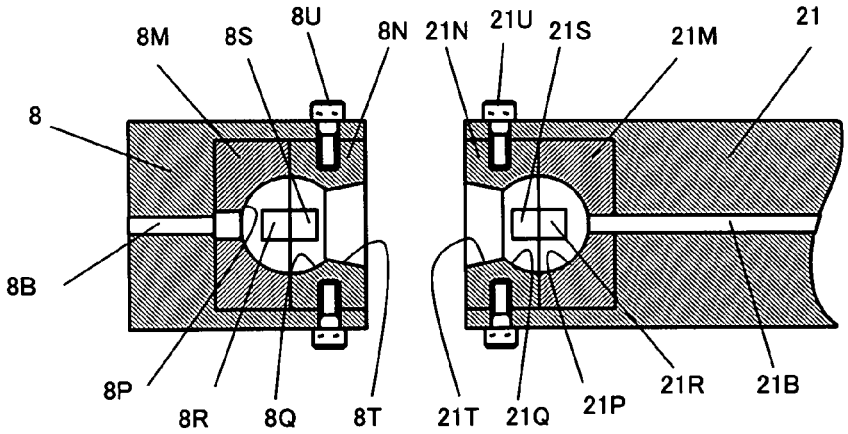
FIG. 9 is a sectional view representing the state where the swing column is removed from the assembled part of the swing column according to the fifth embodiment.

FIGS. 6 to 9 illustrate a fifth embodiment. FIG. 6 illustrates a vacuum pump having the swing column 37 installed therein. FIG. 7 illustrates an assembled part of the swing column 37. FIG. 8 is an outer appearance of the swing column 37 shown in FIG. 7, which is turned at 90°. FIG. 9 represents the state where the assembled part shown in FIG. 7 is turned at 90° while removing the swing column 37. Explanations of the same components and codes shown in FIGS. 6 to 9, which have been described in the first to the fourth embodiments will be omitted. The spherical base 8M is attached to the fixed portion 8. A spherical base 21M is attached to the pivot shaft 21. After inserting the cylinder 37F through holes 8T and 21T of stoppers 8N and 21N, respectively, the spheres 37A and 37B are formed at both ends of the cylinder 37F. Thereafter, a bolt 8U fixes a stack of the stopper 8N and the spherical base 8M to the fixed portion 8. A bolt 21U fixes a stack of the stopper 21N and the spherical base 21M to the pivot shaft 21.

The spherical base 8M includes a bearing (concave spherical bearing) 8P and a guide groove 8R. The width of the guide groove 8R is substantially equal to the diameter of the pin 37D. The stopper 8N includes a bearing (concave spherical bearing) 8Q and a guide groove 8S. The width of the guide groove 8S is substantially equal to the diameter of the pin 37D. The sphere 37A at one end of the swing column 37 is swingably fitted to the bearings (concave spherical bearings) 8P and 8Q. The pin 37D is slidably fitted to the guide grooves 8R and 8S. The swing column 37 is allowed to have a swingable motion while being prevented from moving in the axial direction and rotating relative to the fixed portion 8.

The spherical base 21M includes a bearing (concave spherical bearing) 21P and a guide groove 21R. The width of the guide groove 21R is substantially equal to the diameter of the pin 37E. The stopper 21N includes a bearing (concave spherical bearing) 21Q and a guide groove 21S. The width of the guide groove 21S is substantially equal to the diameter of the pin 37E. The sphere 37B at the other end of the swing column 37 is swingably fitted to the bearings (concave spherical bearings) 21P and 21Q. The pin 37E is slidably fitted to the guide grooves 21R and 21S. This allows the swing column 37 to have the swingable motion while being prevented from moving in the axial direction and rotating. The pivot shaft 21 is prevented from rotating. Self-rotation of the orbiting scroll 11 integrated with the pivot shaft 21 may be prevented. In the aforementioned way, the swing column 37 is swingably operated while being prevented from self-rotating for preventing self-rotation of the orbiting scroll 11.

The direction of the thrust load generated in the vacuum pump shown in FIG. 6 is opposite to the direction of the thrust load generated in the compressor shown in FIG. 1. The pressure in the work chamber (compression chamber) 16 of the compressor is higher than the outside, and accordingly, the thrust load is generated in the direction where the orbiting scroll 11 moves away from the fixed scroll 15. The force of the orbiting scroll 11 is applied to press the pivot shaft 21. However, in the case of the vacuum pump, the pressure in the work chamber (pump chamber) 16 is lower than the outside. As a result, the thrust load is generated toward the direction where the orbiting scroll 11 is drawn to the fixed scroll 15. The force is applied so that the orbiting scroll 11 pulls the pivot shaft 21. The sphere 37A (at one end of the swing column 37) fitted to the bearings (concave spherical bearings) 8P and 8Q of the fixed portion 8 serves as the support point. The sphere 37B (at the other end of the swing column 37) fitted to the bearings (concave spherical bearings) 21P and 21Q of the pivot shaft 21 revolves while following the movement of the pivot shaft 21. The swing column 37 receives(withstands) the thrust load from the bearings 21P, 21Q, and the sphere 37B transferred to the pivot shaft 21 from the orbiting scroll 11, and transfers to the fixed portion 8 from the sphere 37A, and the bearings 8Q and 8P. As the fixed portion 8 is fixed, the swing column 37 is kept stationary. As the swing column 37 does not move, the pivot shaft 21 is kept stationary. As the pivot shaft 21 does not move, the orbiting scroll 11 is kept stationary.

According to the fifth embodiment, the orbiting scroll 11 is fixed not only in the direction away from the fixed scroll 15, but also in the direction drawn to the fixed scroll 15. As a result, the orbiting scroll 11 is not drawn to the side of the fixed scroll 15. The vacuum pump, thus requires no bearing which withstands the thrust load, resulting in the simplified bearing structure with reduced mechanical loss. The swing column 37 prevents self-rotation of the orbiting scroll 11. Accordingly, the vacuum pump requires no dedicated component for preventing self-rotation, resulting in the simplified structure.

COMPARATIVE EXAMPLE 1

Figure 10:
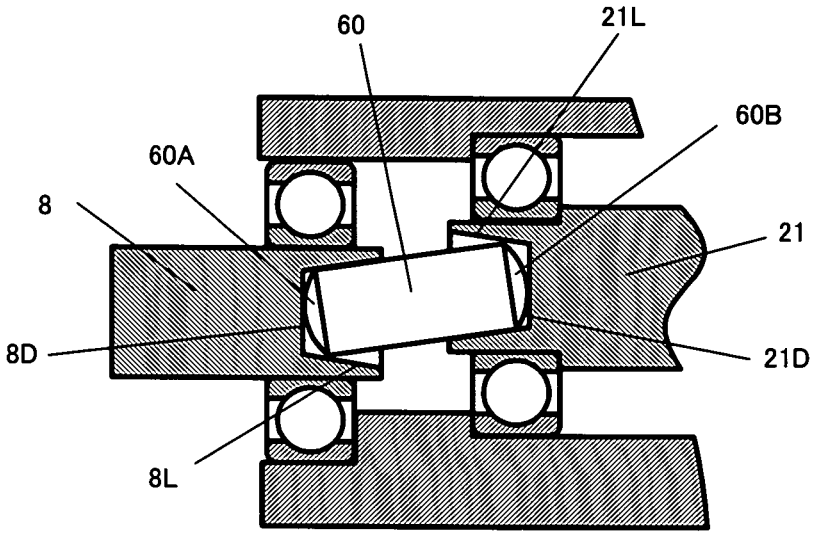
FIG. 10 is a sectional view illustrating an assembled part of a swing column of a compressor according to a comparative example.

FIG. 10 illustrates an assembled part of a swing column 60 according to a comparative example. A spherical surface 60A at one end of the swing column 60 and a spherical surface 60B at the other end form a part of the sphere with the diameter equivalent to the entire length of the swing column 60. The fixed portion 8 includes a bearing (plane bearing) 8D and a bank 8L at the leading end. The pivot shaft 21 includes a bearing (plane bearing) 21D and a bank 21L at the rear end. The swing column 60 is attached between the bearings 8D and 21D. The spherical surface 60A fitted to the bearing (plane bearing) 8D of the fixed portion 8 serves as the support point. The spherical surface 60B fitted to the bearing (plane bearing) 21D of the pivot shaft 21 revolves while following the movement of the pivot shaft 21. The swing column 37 withstands the thrust load of the pivot shaft 21 from the bearing 21D and the spherical surface 60B, and transfers the load to the fixed portion from the spherical surface 60A and the bearing 8D. The banks 8L and 21L are guides which prevent disengagement of the swing column 60. Although the swing column 60 does not have the oil hole, the oil is supplied by the method different from that described in the first embodiment. The compressor according to this comparative example has less mechanical loss because the swing column 60 is in rolling contact with the bearings 8D and 21D.

COMPARATIVE EXAMPLE 2

Figure 11:
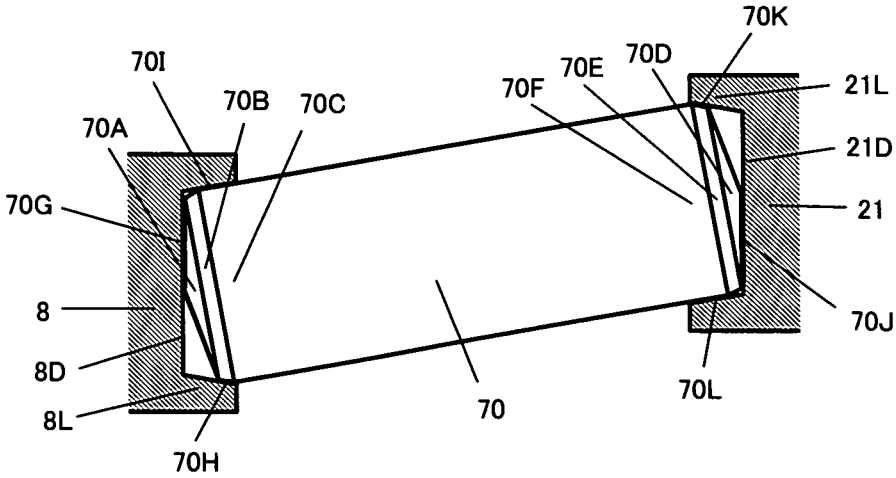
FIG. 11 is a sectional view illustrating an assembled part of a swing column of a compressor according to a comparative example.

FIG. 11 illustrates an assembled part of a swing column 70 according to a comparative example. The swing column 70 includes a conical portion 70A, a chamfered portion 70B, and a columnar portion 70C at one end, and a conical portion 70D, a chamfered portion 70E and a columnar portion 70F at the other end. The fixed portion 8 includes a bearing (plane bearing) 8D and a bank 8L at the leading end. The pivot shaft 21 includes the bearing 21D and the bank 21L at the rear end. The swing column 70 is attached between the bearings 8D and 21D. The conical portion 70A, the chamfered portion 70B and the columnar portion 70C (at one end of the swing column 70) that are fitted to the bearing (plane bearing) 8D of the fixed portion 8 serve as the support point. The conical portion 70D, the chamfered portion 70E and the columnar portion 70F (at the other end of the swing column 70) that are fitted to the bearing (plane bearing) 21D of the pivot shaft 21 revolve while following the movement of the pivot shaft 21. The swing column 70 withstands the thrust load of the orbiting scroll 11 transferred to the pivot shaft 21 from the bearing 21D, the conical portion 70D, the chamfered portion 70E and the columnar portion 70F. The load is then transferred from the columnar portion 70C, the chamfered portion 70B, the conical portion 70A and the bearing 8D to the fixed portion 8. A chamfer contact portion 70H and a column contact portion 701 contact the bank 8L. A chamfer contact portion 70K and the column contact portion 70L contact the bank 21L so as to prevent disengagement of the swing column 70. Upon contact with the banks 8L and 21L, the chamfer contact portions 70H and 70K serve to prevent wear of the swing column 70. The compressor according to this comparative example allows the swing column 70 to be in rolling contact with the bearings (plane bearings) 8D and 21D so that substantially no slippage occurs, thus reducing the wear at the contact portion and mechanical loss. The bearings (plane bearings) 8D and 21D are in liner contact with the conical contacts 70G and 70J to increase the area of the contact portion to be wider than the area in the case of point contact, which is capable of withstanding the higher thrust load.

COMPARATIVE EXAMPLE 3

Figure 12:
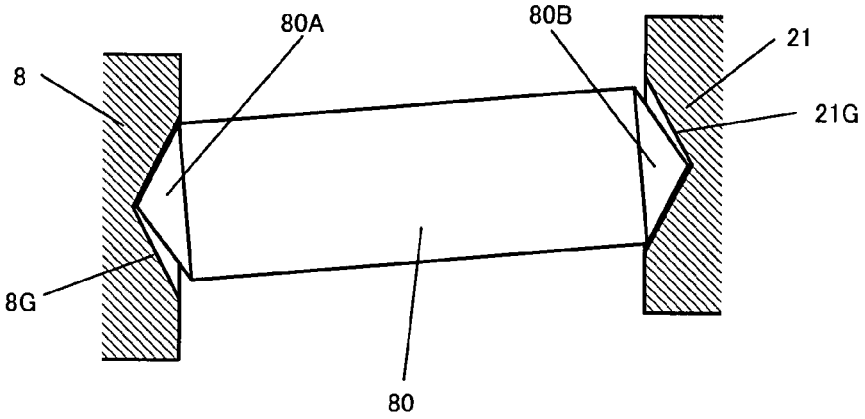
FIG. 12 is a sectional view illustrating an assembled part of a swing column of a compressor according to a comparative example.

FIG. 12 illustrates an assembled part of a swing column 80 according to a comparative example. The swing column 80 includes conical portions 80A and 80B at one end and the other. The fixed portion 8 includes a bearing (conical bearing) 8G at its leading end. The pivot shaft 21 includes a bearing (conical bearing) 21G at the rear end. The swing column 80 is attached between the bearings 8G and 21G. The conical portion 80A (at one end of the swing column 80) fitted to the bearing 8G of the fixed portion 8 serves as the support point. The conical portion 80B (at the other end of the swing column 80) fitted to the bearing 21G of the pivot shaft 21 revolves while following the movement of the pivot shaft 21. The swing column 80 withstands the thrust load of the orbiting scroll 11 transferred to the pivot shaft 21 from the bearing 21G and the conical portion 80B. The load is then transferred from the conical portion 80A and the bearing 8G to the fixed portion 8. The compressor according to the eighth embodiment has a low mechanical loss as the swing column 80 is in rolling contact with the bearings 8G (conical bearing) and 21G. The swing column 80 is less-wearing because of large areas of the conical portions 80A and 80B in contact with the bearings 8G and 21G. The bearings 8G and 21G each having the conical surface serve as guides which prevent disengagement of the swing column 80, resulting in a simplified structure of the compressor.

Sixth Embodiment

Figure 13:
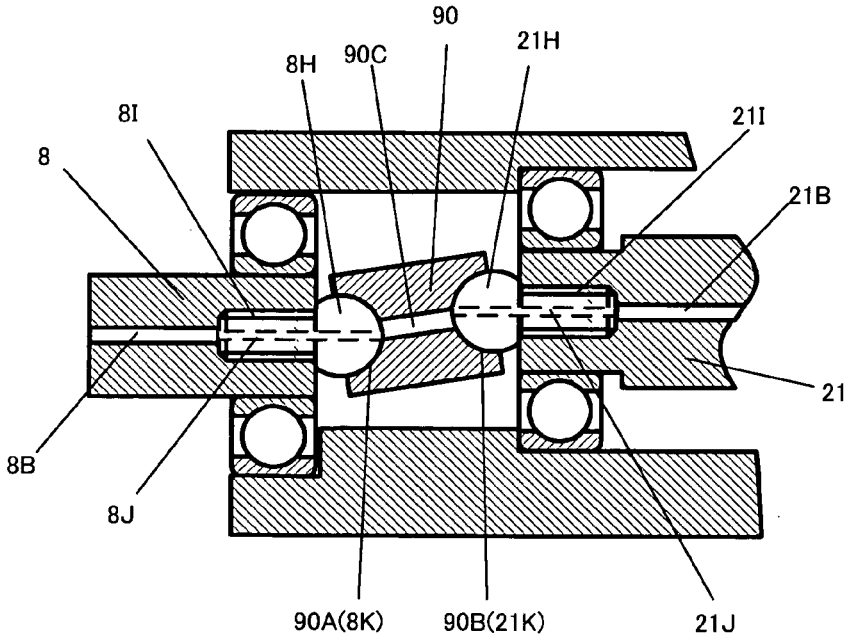
FIG. 13 is a sectional view illustrating an assembled part of a swing column of a compressor according to a sixth embodiment.

FIG. 13 illustrates an assembled part of a swing column 90 of a compressor according to a sixth embodiment. The parts other than those illustrated are the same as illustrated in FIG. 1. The swing column 90 includes concave spherical surfaces 90A and 90B at one end and the other, respectively. The fixed portion 8 includes a sphere 8H integrated with a screw 81 at the leading end. The pivot shaft 21 includes a sphere 21H integrated with a screw 211 at the rear end. The swing column 90 is attached between the spheres 8H and 21H. The concave spherical surface 90A (at one end of the swing column 90) fitted to the bearing (convex spherical bearing) 8K of the fixed portion 8 serves as the support point. The concave spherical surface 90B (at the other end of the swing column 90) fitted to the bearing (convex spherical bearing) 21K of the pivot shaft 21 revolves while following the movement of the pivot shaft 21. The swing column 90 withstands the thrust load of the pivot shaft 21 from the bearing (convex spherical bearing) 21K and the concave spherical surface 90B. The load is then transferred from the concave spherical surface 90A and the bearing (convex spherical bearing) 8K to the fixed portion 8. The swing column 90 includes an oil passage 90C which penetrates through the axis core. The spheres 8H and the screw 81 include an oil passage 8J which penetrates the axial center. The sphere 21H and the screw 211 include an oil passage 21J which penetrates through the axis core. The oil passages 8B, 8J, 90C, 21J and 21B are communicated with one another to form the oil supply path. One of the concave spherical surfaces 90A and 90B of the swing column 90 may be replaced with a sphere, and the bearing (concave spherical bearing) may also be provided at the leading end of the fixed portion 8 or the rear end of the pivot shaft 21 to be fitted to the sphere. In the sixth embodiment, the diameter of the swing column 90 may be set to a relatively large value, thus allowing the structure to sufficiently withstand the high thrust load.

What is claimed is:

1. A scroll fluid machine comprising:

a casing;

a rotary shaft having a hollow portion, the rotary shaft being provided inside the casing and supported at a bearing for rotation;

a pivot shaft provided in the hollow portion of the rotary shaft and supported at a bearing eccentrically located from an axial center of the rotary shaft for orbital revolution;

an orbiting scroll engaged with a leading end of the pivot shaft for orbital revolution while being prevented from self-rotating by a self-rotation prevention mechanism; and a fixed scroll provided opposite the orbiting scroll, which defines a work chamber with the orbiting scroll, the scroll fluid machine further comprising:

a fixed portion on a bottom of the casing;

a swing column between the fixed portion and the orbiting scroll, or between the fixed portion and the pivot shaft to withstand the thrust load;

the fixed portion includes a bearing fitted to one end of the swing column;

the orbiting scroll or the pivot shaft includes a bearing fitted to the other end of the swing column;

the swing column includes convex or concave spherical surface at one end and the other end;

the swing column further includes the oil passage which penetrates through the axis core to supply the oil to the portion where the bearing of the fixed portion is fitted to the one end of the swing column, and to further supply the oil to the portion where the bearing of the orbiting scroll or the bearing of the pivot shaft is fitted to the other end of the swing column;

the means for supplying the oil to the swing column;

the one end of the swing column fitted to the bearing of the fixed portion serves as a support point; and the other end of the swing column fitted to the bearing of the orbiting scroll or the bearing of the pivot shaft revolves while following the movement of the orbiting scroll or the pivot shaft.

2. The scroll fluid machine according to claim 1, wherein the swing column has a swingable motion while being prevented from self-rotating and prevents a self-rotation of the orbiting scroll.

3. The scroll fluid machine according to claim 1, wherein:

the one end and the other end of the swing column are each provided with a columnar pin;

each axis of the pins passes through an axis of the swing column;

each of the pins orthogonally crosses the swing column;

a guide groove is formed in the fixed portion and the orbiting scroll, or the fixed portion and the pivot shaft;

each of the guide grooves accommodates one of the pins; and the guide groove has a width equal to or slightly wider than a diameter of the pin, by which the swing column has a swingable motion while being prevented from self-rotating and prevents a self-rotation of the orbiting scroll.

* * * * *